US005641298A

United States Patent [19]

Holloway

[11] Patent Number: 5,641,298

[45] Date of Patent: Jun. 24, 1997

[54] LOCKING DEVICE FOR PLUG-SOCKET ELECTRICAL CONNECTOR

[76] Inventor: Steven E. Holloway, 1202 Land Rush, Arlington, Tex. 76102

[21] Appl. No.: 509,974

[22] Filed: Aug. 1, 1995

[51] Int. Cl.[6] ..... H01R 4/50

[52] U.S. Cl. ..... 439/346

[58] Field of Search ..... 439/346, 345, 439/304, 347, 369

[56] References Cited

U.S. PATENT DOCUMENTS

| | | | |
|---|---|---|---|
| 2,704,831 | 3/1955 | Smith . | |
| 3,281,758 | 10/1966 | Appleton | 339/91 |
| 3,489,989 | 1/1970 | Robaczewski | 339/75 |
| 3,942,856 | 3/1976 | Mindheim et al. | 339/74 R |
| 4,061,409 | 12/1977 | Bealmear | 339/75 |
| 4,085,991 | 4/1978 | Marshall et al. | 339/75 P |
| 4,136,919 | 1/1979 | Howard et al. | 439/346 |
| 4,925,396 | 5/1990 | Grover | 439/147 |
| 4,932,886 | 6/1990 | Glaser | 439/137 |
| 4,969,833 | 11/1990 | Lindow et al. | 439/133 |
| 5,316,493 | 5/1994 | Sowers | 439/346 |

*Primary Examiner*—Khiem Nguyen
*Assistant Examiner*—Yong Ki Kim
*Attorney, Agent, or Firm*—Akin, Gump, Strauss, Hauer & Feld, L.L.P.

[57] ABSTRACT

A locking device for plug and socket type electrical connectors includes a flexible nonconductive pin for insertion through the socket cover plate and the socket body of a recessed wall type socket connector member or a socket connector member disposed in an enclosure which prevents insertion of the pin in a direction generally normal to the direction of engagement of the plug with the socket member. A guide tube is disposed between the socket body and the socket cover plate for guiding the pin through essentially a right angle turn so that the pin may be inserted in and removed from the socket from the plane of the cover plate. The pin includes an elastically deflectable shank portion and a head having a tool engaging part and a threaded shank part for engagement in an internally threaded bore in the socket cover plate or a bushing insert disposed on the socket cover plate. An electrical power cord plug and socket type connector is provided with a locking pin for registration with the socket contactor blades and the plug prongs and which has a flexible shank portion and an anchor portion engaged with the socket body so that the pin may be elastically deflected to be inserted in and removed from the socket body for locking a plug in engagement with the socket.

17 Claims, 2 Drawing Sheets

LOCKING DEVICE FOR PLUG-SOCKET ELECTRICAL CONNECTOR

FIELD OF THE INVENTION

The present invention pertains to a locking device to prevent disconnection of a plug-socket type electrical connector, particularly adapted for recessed wall electrical socket outlet assemblies and plug-socket power cord connections.

BACKGROUND

There are many reasons why it is undesirable to have inadvertent disconnection of a plug-socket type electrical connection. The conventional two-pronged and three-pronged plug and socket type electrical connection is ubiquitous in household and industrial electrical distribution systems and in power cords used for myriad purposes. Unwanted removal of a plug from a socket type connector is at least inconvenient, can result in economic loss due to damage to computers, power tools, failure of heating and refrigeration systems and many, many other applications of electrical power. Still further, the risk of exposure of a live electrical socket connector element to unwanted insertion of conductor means or contact with humans can be injurious, if not fatal.

Accordingly, there has been a long felt need to provide suitable means for preventing unwanted disconnection of plug-socket type electrical connectors and to prevent the removal of isolator or socket cover devices to minimize the risk of persons, such as small children and infants, coming into contact with the socket connector elements.

Various devices have been developed for preventing the removal of a plug from a socket type connector element. It has been suggested to provide mechanism which includes a pin insertable through the socket contactor element and through conventional holes or openings formed in the prongs of conventional plug members. Prior art devices are relatively complicated and, generally, are not adapted for use with recessed socket type connectors typically mounted in a building wall or other structures so that the socket member is substantially co-planar with the wall surface. Certain devices have been developed to overcome this deficiency included a device which includes a relatively complicated mechanical linkage which is mounted on and within a recessed wall type socket enclosure. Alternatively, add on type socket connectors including multiple pairs of socket contactors have been developed which include relatively complicated combinations of switch and locking pin members which are insertable through the prongs of the plug member when it is engaged with the socket contactors to lock the connector in assembly.

Still further, there have been efforts to develop locking devices for power cord connections of the plug-in socket type, which devices are also relatively complicated and are not easily retrofitted to existing power cords.

The present invention overcomes some of the deficiencies of existing locking devices for plug and socket type connectors, as will be appreciated by those skilled in the art from reading the following summary, detailed description and claims.

SUMMARY OF THE INVENTION

The present invention provides an improved locking device for plug and socket type electrical connectors. In particular, the invention provides an improved locking device for a plug and socket type electrical connector wherein the socket connector element is mounted in a recess in a wall or other structure. Still further, the invention provides an improved locking device for a plug and socket connector for power cords and the like.

In accordance with one aspect of the present invention, a locking device for a recessed wall mounted socket for a plug and socket type connector is provided wherein a flexible pin is insertable in the socket body while mounted in a wall recess from the front face of the socket body, including a socket cover plate. The socket body includes a unique guide member which is operable to guide the flexible pin through a substantially right angle path of movement from the front face of a socket cover plate and wherein the pin is operable to be inserted through the socket body, the socket contactor members and the prongs of the plug when it is inserted in the socket. The socket cover plate is adapted to include an internally threaded pin receiving bore which is engageable with a threaded shank portion of the flexible pin to lock the pin in place once it has been inserted in the socket body. Still further, the locking device for a plug and socket type connector in accordance with the invention contemplates the provision of an elastically deflectable locking pin which is operable to be bent or deflected through a substantial change of direction while being operable to be rotated to threadedly engage the pin shank with a threaded retainer disposed on a socket body cover plate or on the socket body.

In accordance with yet a further aspect of the present invention, a unique locking device for a plug and socket type electrical connector is provided wherein a nonconductive pin locking member is insertable through the socket contactor elements, the prongs of the connector plug and includes a threaded shank portion cooperable with internally threaded parts associated with the connector to prevent unwanted removal of the pin.

The present invention also provides a flexible pin locking device for a plug and socket power cord type connection. The locking pin is operable to be retrofitted to existing power cord connectors or may be easily provided as part of a power cord connector at the time of original manufacture and sale.

The locking device of the invention is economical to manufacture and install, minimizes the chance of unwanted disconnection of a plug and socket type electrical connection and may be easily included in the socket element at the time of manufacture or retrofitted thereto.

Those skilled in the art will further appreciate the above-mentioned features and advantages of the present invention together with other important aspects thereof upon reading the detailed description which follows in conjunction with them drawing.

DESCRIPTION OF PREFERRED EMBODIMENTS

Figure 1:
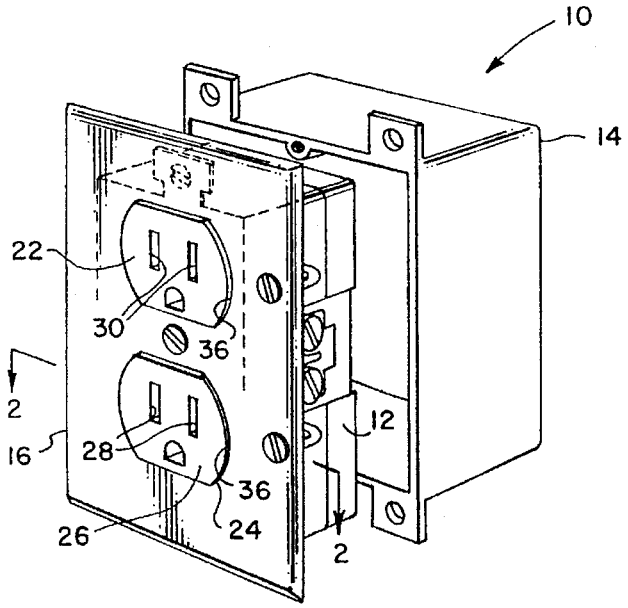
FIG. 1 is a perspective view of a recessed socket type connector element including the locking device of the present invention.

In the description which follows like parts are marked throughout the specification and drawing with the same reference numerals, respectively. The drawing figures are not necessarily to scale in the interest of clarity and conciseness.

Figure 2:
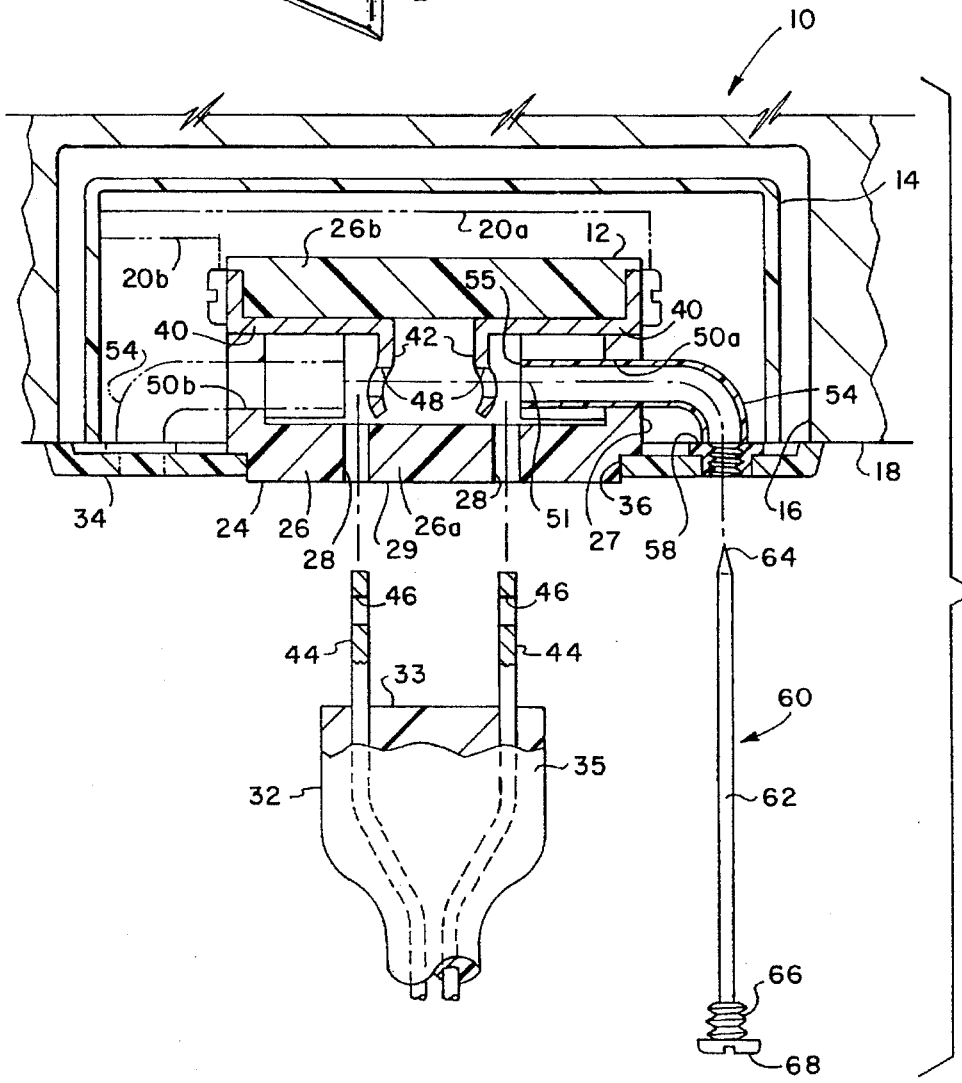
FIG. 2 is a section view taken along the line 2—2 of FIG. 1.

Referring to FIGS. 1 and 2, one preferred embodiment of a locking type electrical connection and associated locking device is illustrated and generally designated by the numeral 10. The exemplary electrical connection comprises a socket type connector 12 of conventional construction, except as otherwise described herein, which is adapted to be mounted in a conventional, generally rectangular boxlike enclosure or receptacle member 14, which in turn may be mounted in a suitable recess 16 in a building wall 18, for example. The wall 18 may also be part of a cabinet or substantially any other structure which is operable to receive and support the connector 12 and enclosure 14. In many applications, the enclosure 14 may itself be exposed but forms a recess or receptacle for the connector 12. Conventional electrical conductors 20*a*, 20*b*, for example, are adapted to be connected to suitable conductor members disposed on the connector 12. The member 12 is of a type which, as shown by way of example in FIG. 1, includes two socket portions 22 and 24 which are of essentially identical construction and comprise a body 26 having spaced apart pairs of slots 28 and 30, respectively, for receiving separate two or three pronged plug type connectors 32, one shown in FIG. 2. The connector 10 is adapted to include a generally planar nonconductive cover plate 34 of conventional construction, except as modified by the present invention, including suitable openings 36 for the socket body portions 22 and 24 which project through such openings. The cover plate 34 is of generally rectangular configuration and is of a predetermined size to cover the receptacle or enclosure 14 as well as the recess 16, if appropriate.

As further shown in FIG. 2, the connector body 26 is typically a nonconductive plastic member having a first body portion 26*a* and a base portion 26*b*. The base portion 26*b* adapted to support opposed electrically conductive contactor strips 40, each having spaced apart contactor blades 42, one shown for each strip in FIG. 2. The contactor blades 42 are aligned with the slots 28 and 30 in the respective socket portions 22 and 24 of the body 26 for receiving and forcibly engaging generally flat blade like prongs 44 of the plug 32. Each of the prongs 44 has a conventional, generally circular hole or opening 46 formed therein aligned with the hole or opening of the other prong. As shown in FIG. 2, each of the contactor blades 42 is also provided with a circular opening or hole 48 operable to be aligned with the holes 46 when the prongs 44 are inserted in the slots 28 or 30 and in engagement with the socket body 26.

As further shown in FIG. 2, the body portion 26*a* has been modified to include opposed cylindrical bores 50*a* and 50*b* which are aligned with the circular openings 48 in the contactor blades 42, as indicated by the axis 51.

The unique locking connector 10 also includes guide means comprising a curved, generally cylindrical plastic tube 54 which is insertable in the openings 50*a* or 50*b*, as desired, and is curved at a 90° angle to be aligned with an internally threaded bushing 58 disposed on the cover plate 34, as shown. Guide tubes 54 may be mounted on either or both sides of the connector body part 26*a*, as indicated by the alternate position lines in FIG. 2 and the cover plate 34 may be provided with bushings 58 on both sides of the openings 36 or, if provided on only one side, the cover plate may be inverted to align the bushings 58 with the guide tubes 54, depending on their location. As shown in FIG. 2, the guide tube 54 projects through a wall portion 27 of the body 26 and may extend to a distal end 55 directly adjacent one of the contactor blades 42 to be aligned with the openings 48 in the contactor blades for guiding a unique locking pin 60 through the openings 48 and the openings 46 in the plug prongs 44 when the prongs are inserted in engagement with the contactor blades 42. The guide tube 54 may also be inserted only partly through the wall 27 of the body portion 26*a* or simply aligned with an appropriate opening 50*a* or 50*b*. However, the distal end of the tube 54 should extend to a position to provide for proper guidance of the pin 60. The guide tube 54 may be formed of a suitable thermoplastic and preformed to have the right angle curvature illustrated.

Referring further to FIG. 2, the locking pin 60 includes an elongated generally cylindrical shank 62, preferably having a somewhat pointed distal end 64. The shank 62 is connected to or formed integral with an externally threaded enlarged diameter shank portion 66 which includes a conventional slotted pan type screw head 68, for example. The shank 62 is preferably formed of an electrically nonconductive elastically deflectable polymer material, such as nylon, for example. For a conventional household plug and socket type electrical connector, the pin shank 62 may be from about 0.06 inches to 0.08 inches diameter and the outside diameter of the tube 54 may be a nominal 0.125 inches.

When the plug 32 is inserted in the socket slots 28 or 30 so that its prongs 44 engage with the contactor blades 42 and the face 33 of the plug body 35 is typically engaged with the face 29 of the socket body 26, the openings 46 are aligned with the openings 48 and the pin 60 may be inserted through the bushing 58, the guide tube 54 and through the above-mentioned openings in the plug prongs and the socket contactor blades to lock the plug in engagement with the socket 12 to prevent unwanted removal therefrom. Thanks to the provision of the threaded shank portion 66 and the cooperable bushing 58, the pin 60 may be threadedly engaged with the cover plate 34 to prevent unwanted removal of the pin except by use of a suitable tool, such as a screwdriver. Those skilled in the art will recognize that the head 68 may be modified to have a geometry compatible with one of several different types of tools including different types of screwdriver geometries, or the head 68 may be of a configuration suitable for engagement manually or with a wrench. Thanks also to the use of an elastically deflectable material, such as nylon, the elastic shank portion 62 may be rotated even though it is deflected around a 90° angle to permit locking the pin in engagement with the bushing 58. Those skilled in the art will also recognize that the bushing 58 may be formed integral with the cover plate 34 and provided with suitable internal threads engageable with the shank portion 66 of the pin 60.

Accordingly, the above mentioned locking device for a plug and socket type electrical connector is advantageous in that the socket body 26 may be mounted in an enclosure 14 and further wherein the enclosure 14 may be mounted in a wall or cabinet recess 16 which would otherwise prevent insertion of the pin 60 directly into the socket connector 12 as shown by prior art devices. Moreover, the provision of the flexible elastic pin 60 and the guide means formed by the tube 54 permits insertion and removal of the locking device in a recessed socket or one disposed in an enclosure which would otherwise prevent access to the socket body for insertion and removal of the locking device. Still further, the mechanically uncomplicated configuration of the locking pin 60 and the guide means formed by the tube 54 minimize the expense of providing a locking type plug and socket electrical connector.

Installation and operation of the above-mentioned locking device for a plug and socket type electrical connector is believed to be understandable to those of skill in the art from the foregoing description. The socket connector 12 and the cover plate 34 may be fabricated initially with the features shown including the openings 50*a* and 50*b*, the guide tube 54 and the bushing 58. Alternatively, existing socket members and cover plates may be retrofitted with a bushing type insert 58 in the cover plate 34 and with the guide tube 54 either connected to the socket body 26 or to the cover plate, as desired. Since conventional electrical plugs, such as the plug 32, include the prong openings 46 formed therein, typically no modification to the plug would be required either during initial manufacture or retrofit.

Figure 3:
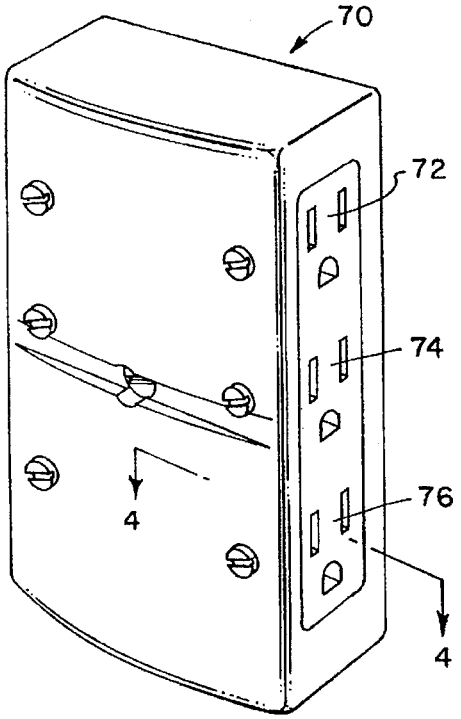
FIG. 3 is a perspective view of a multiple socket connector unit which includes the locking device of the present invention.
Figure 4:
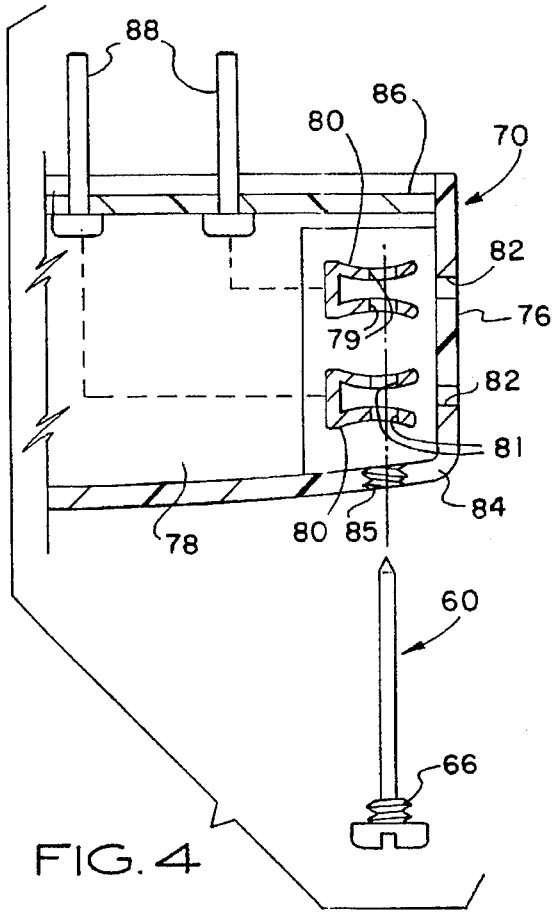
FIG. 4 is a section view taken along the line 4—4 of FIG. 3.

Referring now to FIGS. 3 and 4, the locking device of the invention may also be adapted for single or multiple socket the connector adaptors, one shown in FIG. 3 and generally designated by the numeral 70. The socket adaptor 70 is operable to provide for multiple electrical connections by providing multiple socket connectors 72, 74, 76, for example, which are formed on a connector body 78, FIG. 4, and spaced apart sets of socket contactor blades 80, as shown by way of example in FIG. 4. The contactor blades 80 are aligned with suitable connector plug receiving openings 82 formed in a cover member 84 of the adaptor 70 which is operable to be connected to a suitable base plate 86 of the adaptor. The base plate 86 supports adaptor prongs 88 which may be, in turn, connected to a suitable socket type connector including that shown in FIGS. 1 and 2.

In the multiple connector adaptor 70, the connector body 78 and the contactor blades 80 have been modified to include suitable openings 79 and 81, aligned with each other, respectively, for receiving the pin 60, for example. Although, in the embodiment shown in FIGS. 3 and 4, the pin 60 does not require to be bent around a radius of curvature for engagement to lock a plug, not shown, in engagement with the adaptor 70, the pin 60 is adapted for threaded engagement with the cover 84 at an internally threaded bore 85, formed therein. Bores 85 are provided aligned with each of the socket connectors 72, 74 and 76. Those skilled in the art will appreciate that the opposite side of the connector adaptor 70 may have additional socket connector portions formed therein so that, for example, the adaptor 70 may have six separate plug receiving socket connectors, for example. Each of the connectors may be provided with a suitable locking pin 60 and a modification of the cover 84 to provide internally threaded bores 85 aligned with openings formed in the connector bodies 78 and corresponding holes in each of the contactor blades associated with a connector. Thanks to the provision of the threaded shank portion 66 of the pin 60, it may be positively locked in a working position and requires a suitable tool for removal, thereby further preventing such from occurring when unwanted or as a result of casual tampering.

Figure 5:
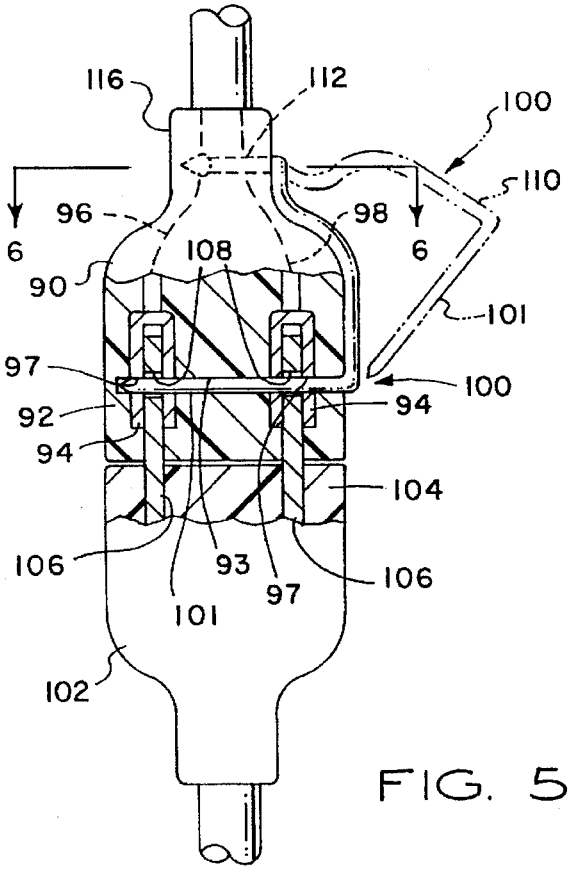
FIG. 5 is a longitudinal central section view of a plug and socket type connector for a power cord in accordance with the present invention.
Figure 6:
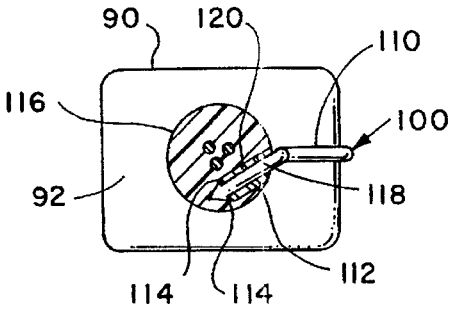
FIG. 6 is a detail section view taken from the line 6—6 of FIG. 5.

The present invention still further contemplates a unique pin type locking device for a plug and socket power cord type connection. Referring to FIGS. 5 and 6, there is illustrated a conventional electrical power cord socket member 90 having a nonconductive body 92 and suitable spaced apart pairs of contactor blades 94 disposed therein. The contactor blades 94 are connected to suitable electrical conductors 96 and 98, respectively. The socket body 92 and the contactor blades 94 are provided with a passage 93 aligned with openings 97, respectively, for receiving a locking pin 100 having a body portion 101 insertable in the socket, as shown for locking a conventional power cord plug 102 in engagement with the socket 90. The plug 102 includes a conventional nonconductive body 104 supporting spaced apart electrically conductive prongs 106 having conventional circular openings 108 formed therein, respectively. As shown in FIG. 5, the openings 108 are operable to be aligned with the passage 93 and openings 97 in the socket member 90 so that the connection between the plug and the socket may be prevented from unwanted disengagement by insertion of the pin 100.

The pin 100 is provided with a flexible shank portion 110 extending from the body 101 and which is preferably shaped to conform to the exterior contour of the connector body 92 and is attached to the connector body by a unique connection, as indicated in the FIGS. 5 and 6. The flexible shank 110 preferably has a distal end 112 comprising a pin anchor portion and being formed with suitable opposed barbs 114. The connector body 92 may be modified at a reduced diameter portion 116, for example, to have a suitable bore 118 formed therein for receiving the shank distal end 112. The bore 118, which may be formed by conventional means, such as drilling, may be sized to be slightly less than the diameter of the barbs 114 so that when the distal end 112 of the pin shank 110 is inserted in the bore 118, the pin shank may not be removed therefrom. Still further, securement of the shank end 112 in the bore 118 may be provided by utilizing a suitable adhesive 120 in the portion of the bore not occupied by the pin shank.

The pin shank 110 has an elastic memory which causes the pin body 101 to be biased to be disposed in the passage 93 and openings 97 in locking engagement with a plug 102, as shown in FIG. 5. However, when it is desired to connect or disconnect the plug 102 with respect to the socket 90, the shank 110 may be grasped and pulled so that the pin body 101 is removed from the socket connector body 92 to allow either insertion of a plug or removal of a plug from registration with the socket member 90. The pin 100 may also be formed of a suitable polymer, such as nylon, and may be of a nominal 0.080 to 0.12 inches diameter.

Those skilled in the art will appreciate that the above-mentioned locking pin for a power cord type connection may be retrofitted to the socket part of the power cord by drilling a suitable bore which projects through the socket body and the contactor blades, only being slightly larger than the diameter of the pin and by drilling the bore 118 in the socket body at a position to provide a suitable length of pin shank 110 to permit movement of the pin body 101 into and out of engagement to perform its locking function. The socket member 90 may be fabricated initially with the pin receiving bores or retrofitted at a later time. The unique pin 100 may be provided as a retrofit kit with suitable instructions for drilling the socket member 90 at the appropriate places such as shown in the drawing figures, to receive the pin body and the pin shank portion.

Fabrication and operation of the locking type power cord plug and socket connector described above is believed to be readily understandable to those skilled in the art from the foregoing description. Moreover, in all of the embodiments of the invention described above, fabrication and installation is believed to be within the purview of the art worker based on the description and drawings hereof.

Although preferred embodiments of the invention have been described in detail herein, those skilled in the art will recognize that various substitutions and modifications may be made to the invention without departing from the scope and spirit of the appended claims.

What is claimed is:

1. A locking device for a plug and socket type electrical connector having a socket body supporting a pair of spaced apart contactor blades, said socket body having respective openings therein aligned with each other for receiving opposed prongs of an electrical conductor plug, said prongs being engageable with said contactor blades and having respective openings alignable with corresponding openings formed in said contactor blades, said locking device comprising;

an elongated pin having an elastically deflectable shank portion which is operable to be deflected for entry into said openings in said contactor blades and said prongs to lock said plug in engagement with said socket body;

a cover plate for said connector; and guide means between said cover plate and said socket body for guiding said pin through a substantially right angle of deflection for entry through said openings in said contactor blades and said prongs for locking said plug in engagement with said socket body.

2. The invention set for in claim 1 wherein:

said socket body includes a body portion having at least one opening formed therein and said guide means comprises a guide tube aligned with said one opening in said body portion and with an opening in said cover plate for guiding said pin into registration with said openings in said contactor blades.

3. The invention set forth in claim 2 wherein:

said pin includes means thereon for locking engagement with said cover plate to prevent unwanted removal of said pin from said socket body.

4. In an electrical connector having a socket body supporting at least one pair of spaced apart contactor blades and a cover plate for said socket body for mounting said socket body in a recess in a wall or like structure, said contactor blades having aligned openings formed therein and aligned with a corresponding opening in said socket body, the improvement comprising:

guide means extending between said cover plate and said socket body for receiving and guiding a deflectable locking pin insertable in an opening in said cover plate for deflection by said guide means through a substantially right angle to pass through said openings in said contactor blades; and an elongated flexible locking pin adapted to be inserted through said cover plate and said guide means for registration with said openings in said contactor blades and corresponding openings in opposed prongs of a connector plug for locking said connector plug in registration with said socket body to prevent disconnection of said prongs from said contactor blades.

5. The invention set forth in claim 4 wherein:

said pin includes means disposed therein for locking engagement with cooperating means formed on said cover plate to prevent unwanted removal of said pin from said socket body.

6. The invention set forth in claim 5 wherein:

said pin includes an elongated elastically deflectable shank portion and a head portion connected to said shank portion and adapted for engagement with a tool for rotating said pin to lock said pin in engagement with cooperating means on said cover plate.

7. The invention set forth in claim 6 wherein:

said pin includes a threaded portion for engagement with cooperating threads on said cover plate for retaining said pin in engagement with said cover plate and projecting through said openings in said contactor blades.

8. The invention set forth in claim 7 wherein:

said shank portion of said pin is formed of an elastically deflectable polymer.

9. The invention set forth in claim 4 wherein:

said guide means comprises a tube interconnecting said socket body and said cover plate.

10. The invention set forth in claim 9 wherein:

said tube projects through an opening in said socket body and has a distal end disposed adjacent to one of said contactor blades for guiding said pin through said openings in said contactor blades, respectively.

11. In an electrical power cord connection including a socket member having a socket body and spaced apart contactor blades for engagement with corresponding prongs on a plug member, the improvement comprising:

a locking pin for engagement with said contactor blades and prongs, respectively, to prevent disconnection of said plug member from said socket member, said contactor blades and said prongs having cooperating openings formed therein for receiving said pin, and said pin including an elongated body portion, an elastically deflectable shank portion connected to said body portion and extending laterally therefrom, and an anchor portion connected to said shank portion at a point spaced from said body portion and engageable with said socket body to provide for elastically deflecting said shank portion to move said body portion between a position for locking said plug member in connection with said socket member and a position to provide for insertion of and/or removal of said plug member with respect to said socket member.

12. The invention set forth in claim 11 wherein:

said anchor portion of said pin includes means engageable with a portion of said socket body to retain said anchor portion of said pin engaged with said socket body.

13. A locking device for a plug and socket type electrical connector having a socket body supporting a pair of spaced apart contactor blades, said socket body having respective openings therein aligned with each other for receiving opposed prongs of an electrical conductor plug, said prongs being engageable with said contactor blades and having respective openings therein alignable with corresponding openings formed in said contactor blades, said locking device comprising;

an elongated pin having a shank portion which is operable to be deflected for entry into said openings in said contactor blades and said prongs to lock said plug in engagement with said socket body;

guide means for guiding said pin through a predetermined angle of deflection for entry through said openings in said contact blades and said prongs for locking said plug in engagement with said socket body;

said socket body including a body portion having at least one opening formed therein, said guide means comprising a guide tube aligned with said one opening in said body portion and with a cover plate for said socket body for guiding said pin into registration with said openings in said contactor blades; and said pin including an elongated elastically deflectable shank portion and a head portion adapted for engagement with a tool for rotating said pin to engage a member associated with said cover plate for retaining said pin in a position to lock said plug in engagement with said socket body and to prevent unwanted removal of said pin from said socket body.

14. The invention set forth in claim 13 wherein:

said cover plate includes an internally threaded portion formed on a bushing supported on said cover plate and engageable with a cooperating threaded portion of said pin.

15. The invention set forth in claim 13 wherein:

said guide tube is configured to cause said pin to be deflected through a right angle between said cover plate and said socket body for registration in said openings in said contactor blades.

16. A locking device for a plug and socket type electrical connector having a socket body supporting a pair of spaced apart contactor blades, said socket body having respective openings therein aligned with each other for receiving opposed prongs of an electrical conductor plug, said prongs being engageable with said contactor blades and having respective openings therein alignable with corresponding openings formed in said contactor blades, said locking device comprising;

an elongated pin having a shank portion which is operable to be deflected for entry into said opening in said contactor blades and said prongs to lock said plug in engagement with said socket body;

guide means for guiding said pin through a predetermined angle of deflection for entry through said openings in said contactor blades and said prongs for locking said plug in engagement with said socket body;

said socket body including a body portion having at least one opening formed therein, said guide means comprising a guide tube aligned with said one opening in said body portion and with a cover plate for said socket body for guiding said pin into registration with said openings in said contactor blades; and said pin including an elongated, generally cylindrical shank portion formed of an elastically deflectable polymer, an integral head part for engagement with a suitable tool for rotating said pin and a threaded portion of said head part for engagement with internal threads formed on said cover plate for locking engagement with said cover plate to prevent unwanted removal of said pin from said socket body and for retaining said pin in registration with openings in said contactor blades and said prongs of said plug for locking said plug in engagement with said socket body.

17. In an electrical power cord connection including a socket member having a socket body and spaced apart contactor blades for engagement with corresponding prongs on a plug member, the improvement comprising:

a locking pin for engagement with said contactor blades and prongs, respectively, to prevent disconnection of said plug member from said socket member, said contactor blades and said prongs having cooperating openings formed therein for receiving said pin, said pin including an elastically deflectable shank portion and an anchor portion connected to said shank portion and engageable with said socket body to provide for elastically deflecting said shank portion to move said pin between a position for locking said plug member in connection with said socket member and a position to provide for insertion of and/or removal of said plug member with respect to said socket member, said socket body including a bore for receiving said anchor portion and said anchor portion including barb means engageable with said socket body to prevent removal of said anchor portion from said socket body.

* * * * *